United States Patent [19]

Lundstrom et al.

[11] Patent Number: 5,067,996

[45] Date of Patent: Nov. 26, 1991

[54] PLASTIC BONDED EXPLOSIVES WHICH EXHIBIT MILD COOK-OFF AND BULLET IMPACT INSENSITIVE PROPERTIES

[75] Inventors: Norman H. Lundstrom, Ogden, Utah; Russell Reed, Jr., Ridgecrest, Calif.

[73] Assignee: The United States of America as represented by the Secretary of the Navy, Washington, D.C.

[21] Appl. No.: 844,548

[22] Filed: Oct. 17, 1977

[51] Int. Cl.[5] ..... C06G 45/10

[52] U.S. Cl. ..... 149/19.4; 149/92; 149/111

[58] Field of Search ..... 149/19.4, 92, 111

[56] References Cited

U.S. PATENT DOCUMENTS

| | | | |
|---|---|---|---|
| 4,018,636 | 4/1977 | O'Neill et al. | 149/19.4 |
| 4,358,327 | 11/1982 | Reed et al. | 149/19.4 |
| 4,976,794 | 12/1990 | Biddle et al. | 149/19.5 |

*Primary Examiner*—Stephen J. Lechert, Jr.

*Attorney, Agent, or Firm*—Melvin J. Sliwka; Sol Sheinbein

[57] ABSTRACT

Castable and elastomeric explosive compositions containing 82–85% HMX in polypropylene-polyethylene type polyurethane binder systems comprising at least 20% 3–5 μHMX and an endothermically pyrolyzable binder.

6 Claims, No Drawings

PLASTIC BONDED EXPLOSIVES WHICH EXHIBIT MILD COOK-OFF AND BULLET IMPACT INSENSITIVE PROPERTIES

BACKGROUND OF THE INVENTION

Explosives contained in ordnance may be exposed to fires aboard aircraft carriers in ammunition storage dumps and during transit. Detonation under such circumstance produces catastrophic results. Providing high explosives which merely burn after being heated in a fire has long been a goal in the explosive arts.

Explosives such as RDX (cyclotrimethylenetrinitramine) or HMX (cyclotetramethylenetetranitramine) have about 1.5 times the explosive power of TNT. However, they are too shock sensitive for use in the pure state and must be mixed with insensitive materials, which of course lower explosive power, for use in ordnance devices. A number of flexible, rubbery binder materials, including polyurethanes have been used with cyclic nitramine explosives (HMX and RDX) to form relatively insensitive and castable or moldable explosive compositions.

In the late sixties, the first elastomeric cast explosive was developed, using RDX and a polyurethane formed from polyethylene glycol and cured with toluene diisocyanate (TDI). This explosive was designated PBXN-106 and requires a plasticizer, the eutectic mixture of the formal and acetal of 2,2 dinitropropanol (BDNPF/A). This explosive is cook-off and bullet resistant but can only be made in limited quantities since BDNPF/A is no longer being made.

The possible unavailability of BDNPF/A prompted the Air Force in the 1970's to develop another castable explosive, PBXF-108, which contains a polyproplene glycol binder cured with three isocyanates: TDI, hexamethylene diisocyanate, and polyphenyl methylene isocyanate (PAPI). Again, about 82% RDX (desensitized by a coating of isodecyl pelargonate) is used in the form of class A 62% (150μ) and class B 20% (44μ).

Another plastic bonded explosive, PBXW-108, using a polyurethane binder was also developed in the early '70's. The binder is hydroxyl-terminated polybutadiene, cured with PAPI. Again the approximately 84% RDX must be coated with a plasticizer (dioctyl adipate) to insure safe handling and a rubbery binder.

Previous plastic bonded high explosives have a number of disadvantages. TDI is a very toxic curative. Polyethylene glycol is hygroscopic and must be handled under dry conditions because TDI and most other isocyanates react with moisture. The use of a plasticizer complicates processing, and plasticizers tend to migrate out of binders. Finally, some explosives, such as PBXF-108, require up to 4 particle sizes of RDX which must be separately prepared.

SUMMARY OF THE INVENTION

Up to 85% HMX particles have been incorporated into a flexible polyurethane binder which exhibits a quenching effect on the explosive by absorbing heat in pyrolysis to form a liquid polyglycol. The binder comprises ethylene oxide capped polypropylene glycol prepolymer and a small amount of ethylene oxide capped polypropylene glycol adduct of trimethylol propane prepolymer cured with nontoxic lysine diisocyanate methyl ester.

When the composition is heated in a warhead, mild rupture (deflagration) rather than detonation occurs.

The composition has also been found to be insensitive to bullet impact.

HMX in fine particles presents a greater surface area and apparently dissipates heat more rapidly and is more susceptible to the quenching effect of the binder. The use of at least two particle sizes of HMX allows the preferred fine particles to pack well with the larger particles to improve processability with high solids loading.

Novel processing techniques incorporating the use of air attritution grinding are utilized to produce fine smooth 3–5μ HMX particles for use in the composition.

DESCRIPTION OF THE PREFERRED EMBODIMENT

Three castable and elastomeric plastic bonded explosive compositions were formulated and evaluated for confined cook-off, bullet impact, thermal stability, performance and mechanical properties. They have been denominated PBXC-119f, 119c, and 120. 119f and 119c are identical with respect to total solids (82%), type of binder and type of explosive (HMX), but differ in the bimodal particle size distribution of the HMX used in the composition. The formulation with the fine particle size distribution of HMX, 119f, had a significantly higher impact value, 39 cm versus 25 cm, then the 119c. The greater surface area associated with the fine particles (about 482 ) apparently dissipates head more rapidly burns more sowly, and is less susceptible to development of hot spots than a coarse distribution.

PBXC-120 is a higher performance 85% HMX filled polyether polyurethane utilizing a trimodal particle size distribution. Having two or three particle sizes of explosive aids high-level solids processing.

Standard particle sizes of HMX were used to formulate the 119c, 119f and 120 compositions. The particles ground by an attrition in a fluid energy mill, designated FEM, are about 3–5μ average particle size, Class B is about 44μ particle size, and Class C is 250μ particle size.

Coarser particles are more likely to fracture against each other which may have a sensitizing effect due to development of stresses within the HMX cyrstals themselves. Also, as the surface to mass ratio of the composition is maximized by incorporation of a fine particle size distribution of nitramine, the quenching effect of the polyurethane binder which involves a pyrolysis to liquid polyglycol species with adsorption of heat from decomposition of the high surface area, small particle size filler, is increased, which plays an important role in the added desensitization of PBXC-119f to impact and cook-off.

The use of fine particles gave a much tougher composition, less susceptible to break-up, making the composition better to handle and less impact-sensitive, as shown in the chart below.

| | PBXC-119f | PBXC-119c | PBXC-120 |
|---|---|---|---|
| Composition (weight percent) | | | |
| HMX, FEM | 24.60 | — | 21.25 |
| HMX, Class B | 57.40 | 24.60 | 21.25 |
| HMX, Class C | — | 57.40 | 42.50 |
| LDIM | 1.75 | 1.75 | 1.46 |
| Pluronic L-35 | 12.70 | 12.70 | 10.58 |
| TPE-4542 | 3.54 | 3.54 | 2.95 |
| Cure catalyst | 0.01 | 0.01 | 0.01 |
| Thermal stability | | | |
| VTS at 100° C., | 0 | | 0 |

-continued

| | PBXC-119f | PBXC-119c | PBXC-120 |
|---|---|---|---|
| ml/g/48 hrs | | | |
| VTS at 120° C., ml/g/48 hrs | | 0.09 | 0.06 |
| Safety data | | | |
| Impact, 50%, cm | 39 | 25 | 28 |
| Friction, 50%, lbs | — | 708 | 794 |
| Electrostatic at 0.25 joule | 10/10 NF | 10/10 NF | 10/10 NF |
| Confined cook-off | | | |
| SCB/no liner | Mild rupture | Mild rupture | Mild rupture |
| Mk 24 Zuni warhead/no liner containing 11 lbs PBX | Mild rupture, no frags | Mild rupture, no frags | Mild rupture, no frags |
| Mechanical properties (5 days from EOM) | | | |
| Shore A hardness | 52 | 52 | 52 |
| Tensile strength, psi | 105 | | |
| Elongation at max load, % | 23 | | |
| Elongation at break, % | 42 | | |
| Modulus, psi | 1260 | | |
| Performance | | | |
| Detonation velocity, meters/sec | 8075 | 8075 | 8275 (est.) |
| Theoretical density, g/cc | 1.635 | 1.635 | 1.675 |

The cure catalyst used was iron acetyl, acetonate. 2,4-Pentanedione in a 2:1 ratio was used to extend pot-life.

The thermal stability was measured as VTS, vacuum thermal stability, wherein the fraction of gas evolved over a given time at a given temperature is measured. Tests indicate a high degree of thermal stability.

The impact, friction, and electrostatic tests are standard explosive safety tests demonstrating the safe handling potential of the present explosives.

The HMX formulations were subjected to confined cook-off studies incorporating unlined Mk 24 Zuni warheads. Each Mk 24 Zuni warheads contained at 11-pound charge of PBX and resulted in a mild rupture of the warhead in each case.

Sixty 50-caliber bullet impact tests were conducted on PBXC-119f, −119c and −120 confined in standard bullet impact pipe nipples under ambient and −60° F. conditions. In all formulations the reaction category was defined as either "no reaction" or a "mild reaction ". Two tests were conducted on PBXC-119f with 50-caliber tracer ball ammunition and were also declared "no reaction".

The detonation velocity of PBXC-119c has been determined as 8075 meters per second at a density of 1.635 g/cc and estimated for PBXC-120 as 8374 meters per second. The high performance of these compositions associated with simple processing, the low number of constituents, and the mild cook-off and bullet insensitive properties make them attractive for warhead fills.

An important feature of the present composition is the nature of the polyether polyurethane binder. Polyethers, such as polytetramethylene glycol or polypropylene glycol, have flexible rather than glassy properties at low temperatures and are easier to process. They are also softer and more chemically stable than other polymeric binders such as polyethylene. The binder is thus very elastomeric so as to act as a cushion and prevent detonation due to bullet impact. The binder also endothermically decomposes, or pyrolyzes, upon heating at a temperature lower than that which decomposes HMX or RDX (536° F. and 399° F., respectively). The binder thus acts as a heat sink to prevent or delay decomposition and possible detonation of the HMX or RDX, known generically as cyclic nitramine explosives.

These and other advantages are realized through the use of a polyether polyurethane binder which is a mixture of ethylene oxide capped polypropylene glycol prepolymer, such as L-35 Pluronic® polyol from BASF Wyandotte Corp., which is a liquid difunctional block polymer terminating in primary hydroxyl groups and has an average molecular weight of 1900. Ethylene oxide capped polypropylene glycol adduct of trimethylol propane, such as TPE-4542, also from BASF Wyandotte Corp., a prepolymer for use in flexible foams, with a 4500 average molecular weight, an average hydroxyl number of 37 KOH/g and a maximum acid number of 0.04, is added as a cross linker. TPE-4542, being itself a block copolymer of polyethylene oxide and polypropylene glycol, and having a primary hydroxyl group could be used in place of L-35 as the resin portion of the binder. L-35 was used because it is more fluid than TPE-4542.

The polypropylene glycol portion of the prepolymers lowers the melting point and imparts liquidity at room temperature, thereby aiding processing, as well as yielding a softer binder.

The phrase "ethylene oxide capped" refers to the fact that the polypropylene prepolymer has a block of polyethylene glycol on each end. L-35 is about 50% polyethylene glycol. The exact amount depends on the molecular weight of the prepolymer. The ratio should be chosen to provide enough polypropylene glycol to keep the prepolymer liquid at room temperature.

The prepolymers are cured with lysine diisocyanate methyl ester (LDIM) or an alternate isocyanate such as hexamethylene diisocyanate, PAPI, TDI, isophorone diisocyonate, or 4,4' diisocyanato dicyclo hexylmethane. The alternates are cheaper, give good mechanical properties and cure rate, but are more toxic.

Processing techniques incorporating the use of fluid energy ground HMX are utilized to prepare these explosive formulations. A fluid energy mill uses a high velocity airstream to whirl particles of HMX in a fluid stream so that the fine 3–5μ HMX particles are produced by particle to particle attrition, yielding rounded HMX particles. The smoothness of HMX particles allows higher solids loading and easier processing.

Otherwise, the mixes are made by standard processing techniques. HMX is blended in one or several additions to the prepolymer and isocyanate. The catalyst is mixed and the material is cast. Mixing is done at a vacuum and 135° F.

What is claimed is:

1. An explosive composition comprising:

82 to 85 weight percent particles of cyclic nitramine explosive of which at least 20 weight percent of said particles are 3–5μ in diameter; and 15 to 18 weight percent polyurethane elastomer formed from ethylene oxide capped polypropylene glycol.

2. The composition of claim 1 wherein said cyclic nitramine explosive is cyclotetramethylenetetranitramine.

3. The composition of claim 2 wherein the aforesaid polyurethane elastomer is further formed from the ethylene oxide capped polypropylene glycol aduct of trimethylol propane.

4. The composition of claim 1 wherein cyclic nitramine explosive particles are present in the ratio 1:1:2 of 3–5μ, 44μ, and 250μ particle sizes respectively.

5. The composition of claim 4 wherein said cyclic nitramine explosive is cyclotetramethylenetetranitramine.

6. An explosive composition consisting essentially of:

82 to 85 percent particles of cyclic nitramine explosive of which at least 20 weight percent of said particles are 3–5μ in diameter; and 15 to 18 weight percent polyurethane elastomer formed from ethylene oxide capped polypropylene glycol.

* * * * *